US007066099B2

(12) United States Patent
Tseng

(10) Patent No.: US 7,066,099 B2
(45) Date of Patent: Jun. 27, 2006

(54) FOLDABLE ARTICLE OF FURNITURE

(76) Inventor: Chun-Hsien Tseng, No. 3, Ting-Hsi Hsin, Lu-Man Tsun, Chu-Chi Hsiang, Chiayi Hsien (TW)

( * ) Notice: Subject to any disclaimer, the term of this patent is extended or adjusted under 35 U.S.C. 154(b) by 15 days.

(21) Appl. No.: 10/705,869

(22) Filed: Nov. 13, 2003

(65) Prior Publication Data

US 2005/0103958 A1 May 19, 2005

(51) Int. Cl.
*A47B 9/02* (2006.01)

(52) U.S. Cl. ..... 108/132; 248/188.6; 403/52

(58) Field of Classification Search ..... 248/188.6, 248/188, 188.1, 188.8, 97, 99; 403/59, 52, 403/61, 62, 68, 70; 108/133, 132, 130, 131
See application file for complete search history.

(56) References Cited

U.S. PATENT DOCUMENTS 1,309,774 A * 7/1919 Otte ..... 108/131
2,425,162 A * 8/1947 Overbey ..... 108/125
3,396,928 A * 8/1968 Lay ..... 248/188.6
3,554,141 A * 1/1971 Burr ..... 108/132
4,144,822 A * 3/1979 Roberts et al. ..... 108/129
5,367,962 A * 11/1994 Tseng ..... 108/127
6,386,119 B1 * 5/2002 Lin ..... 108/133

* cited by examiner

*Primary Examiner*—Ramon O Ramirez
(74) *Attorney, Agent, or Firm*—Jacobson Holman PLLC

(57) ABSTRACT

A foldable article of furniture includes a surrounding top supported frame with a plurality of engaging members secured thereon and extending downwardly therefrom. A plurality of supporting legs have couplers secured on upper sections thereof. A joint interconnects a lower portion of each engaging member and a proximate portion of each coupler such that the proximate portion is turnable and is uprightly movable relative to the lower portion. A locking member is disposed to lock the proximate portion from turning relative to the lower portion when the proximate portion is in an upper position, and to set the proximate portion free from being locked when the proximate portion is in a lower position. A biasing member biases the proximate portion upwardly.

4 Claims, 7 Drawing Sheets

FOLDABLE ARTICLE OF FURNITURE

BACKGROUND OF THE INVENTION

1. Field of the Invention

This invention relates to a foldable article of furniture, more particularly to a foldable article of furniture with a plurality of foldable supporting legs.

2. Description of the Related Art

Referring to FIGS. 1 to 3, a conventional foldable article of furniture 1 is shown to include a surrounding top supported frame 11, four supporting leg units 12, eight biasing springs 13, and eight sliding sleeves 14. The top supported frame 11 is provided with a seat cushion (not shown), and has eight downwardly extending stems 111 that are angularly displaced from one another. Each of the supporting leg units 12 is in form of a V-shaped rod, and includes two upper connecting portions 121, two pivot portions 122 extending from the upper connecting portions 121 and pivotally joined to a respective one of the stems 111 at a joint 123 so that the supporting leg unit 12 is turnable relative to the top supported frame 11 between an upright position (as shown in FIG. 2) and a collapsed position (as shown in FIG. 3). Each of the sliding sleeves 14 is sleeved on a respective one of the joints 123 and a respective one of the stems 111, and has two ends respectively abutting against a lower surface of the top supported frame 11 and the respective biasing spring 13 that is sleeved on the respective upper connecting portion 121.

In the upright position of the supporting leg unit 12 as shown in FIG. 2, a lower bracing portion of the supporting leg unit 12 can stand on the ground surface by means of the sliding sleeve 14 that abuts against the lower surface of the top supported frame 11 to prevent turning of the supporting leg unit 12. When it is desired to fold the foldable article of furniture 1, two corresponding sliding sleeves 14 are moved away from the top supported frame 11 so that the supported leg unit 12 can be turned to the collapsed position shown in FIG. 3. However, the user has to move the two sliding sleeves 14 with both hands during folding of the supporting leg unit 12, which is inconvenient.

SUMMARY OF THE INVENTION

The object of the present invention is to provide a foldable article of furniture which can be folded conveniently.

According to this invention, the foldable article of furniture includes a surrounding top supported frame surrounding a central axis. A plurality of engaging members are secured on the top supported frame, and are angularly displaced from one another. Each of the engaging members includes upper and lower portions which are opposite to each other in an upright direction parallel to the central axis, and which are proximate to and distal from the top supported frame, respectively. Each of supporting legs includes a lower section which is adapted to stand on the ground surface, and an upper section opposite to the lower section in the upright direction. A plurality of couplers are secured on the upper sections of the supporting legs, respectively. Each coupler includes distal and proximate portions which are opposite to each other in the upright direction, and which are distal from and proximate to the upper section, respectively. A joint is disposed to connect the lower portion of a respective one of the engaging members to the proximate portion of a respective one of the couplers such that the proximate portion is turnable relative to the lower portion about a pivot axis that is transverse to the central axis between an upright position, where both the coupler and the engaging member are oriented in the upright direction so as to position the lower section of the respective support leg on the ground surface, and a collapsed position, where the coupler is inclined relative to the engaging member so as to bring the lower section close to the central axis, and such that the proximate portion is movable relative to the lower portion in the upright direction between upper and lower positions. A locking member is disposed to lock the proximate portion of a respective one of the couplers so as to prevent turning of the proximate portion relative to the lower portion of a respective one of the engaging members about the pivot axis when the proximate portion is in the upper position, and to release the proximate portion so as to permit turning of the proximate portion about the pivot axis to the collapsed position when the proximate portion is in the lower position. A biasing member is disposed to bias the proximate portion of a respective one of the couplers towards the upper position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
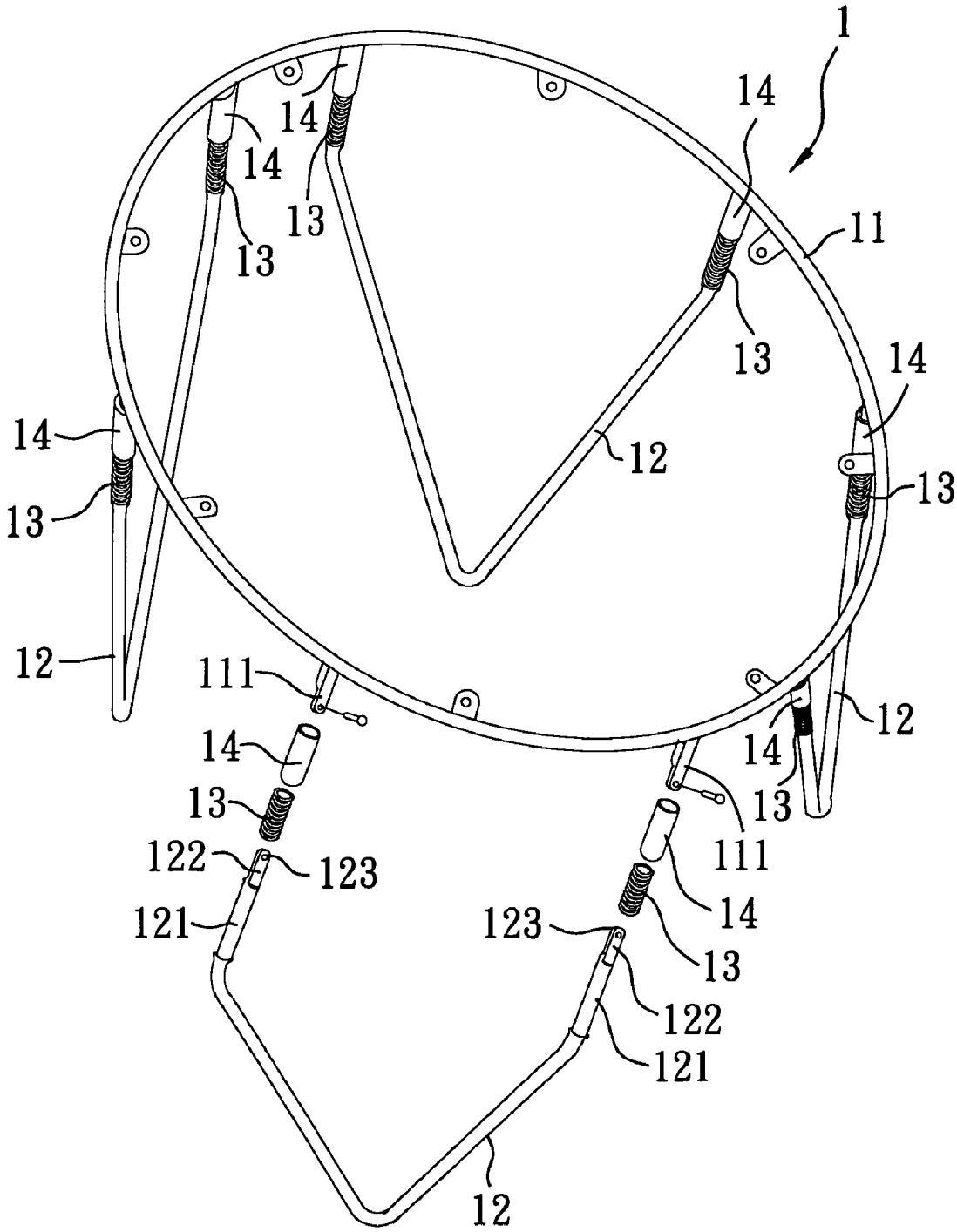
FIG. 1 PRIOR ART
FIG. 1 is a partly exploded perspective view of a conventional foldable article of furniture.
Figure 2:
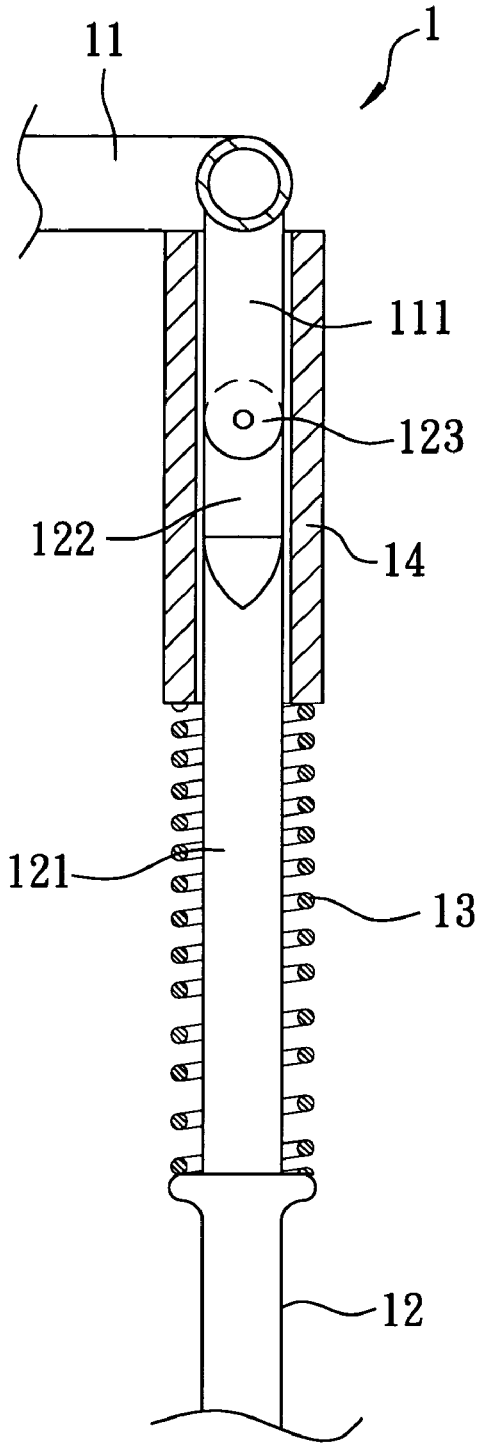
FIG. 2 PRIOR ART
FIG. 2 is a fragmentary partly sectional view of a portion of the conventional foldable article of furniture in an upright state.
Figure 3:
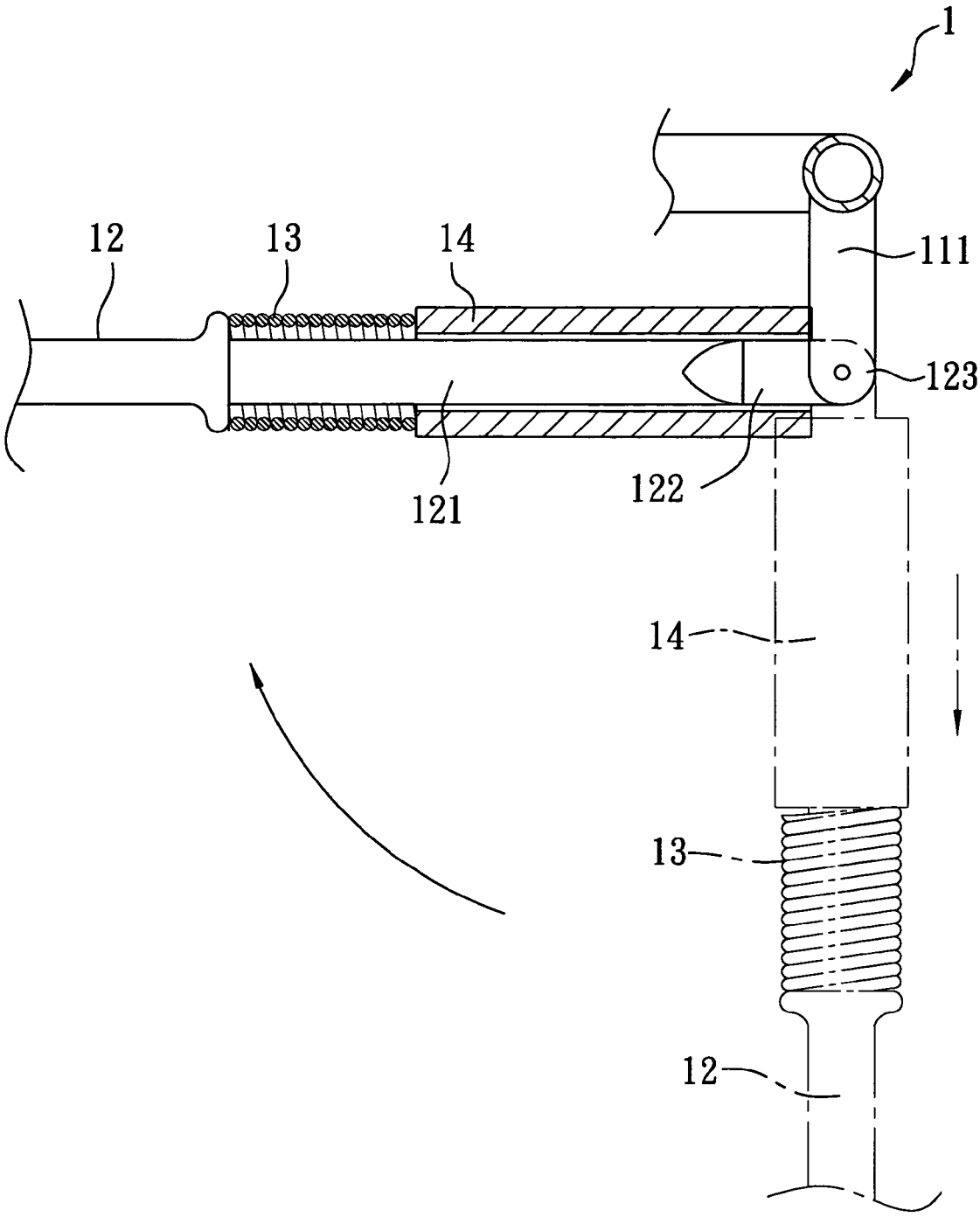
FIG. 3 PRIOR ART
FIG. 3 is a fragmentary partly sectional view of the portion of the conventional article of furniture in a folded state.
Figure 4:
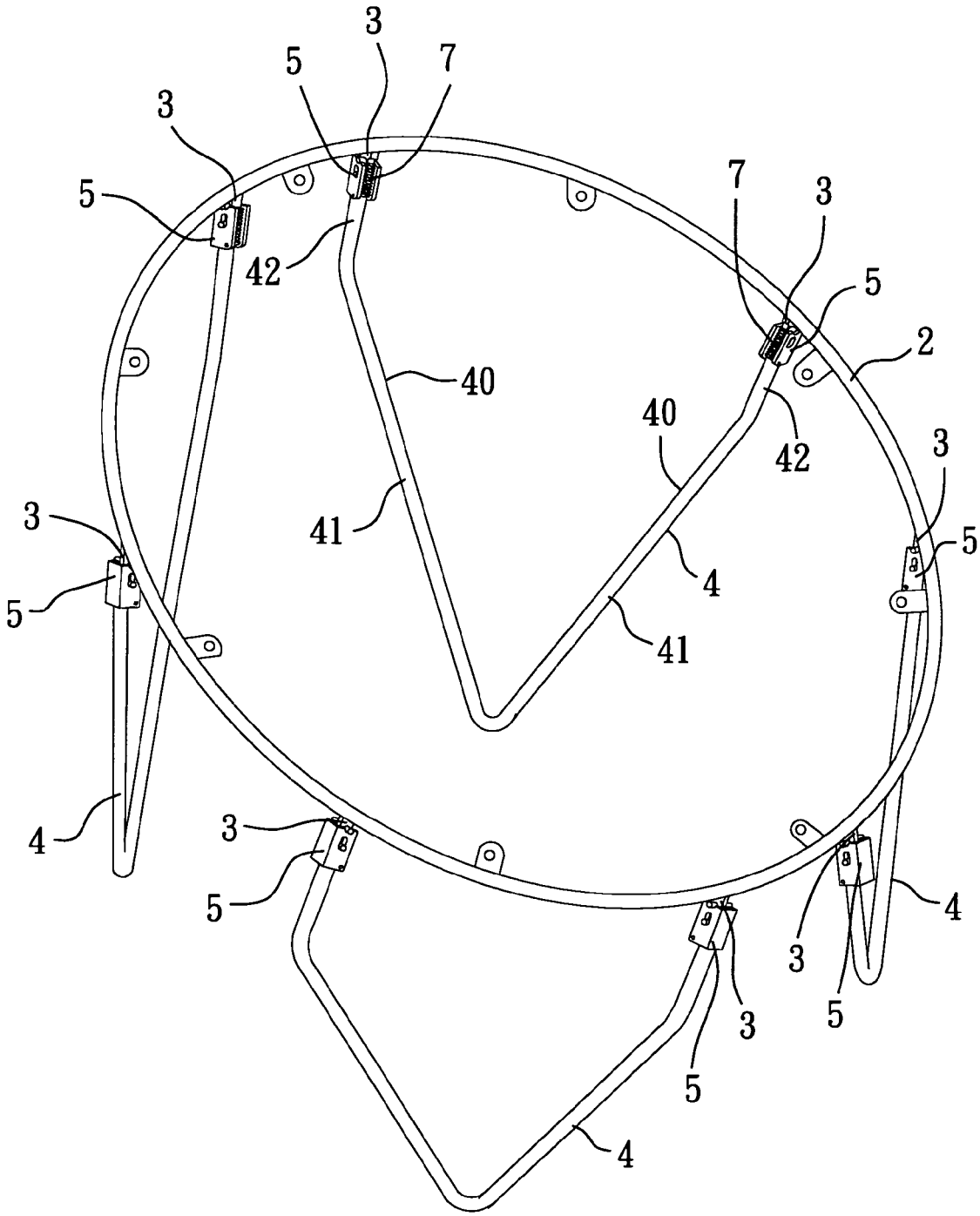
FIG. 4 is a perspective view of the preferred embodiment of a foldable article of furniture according to this invention.
Figure 5:
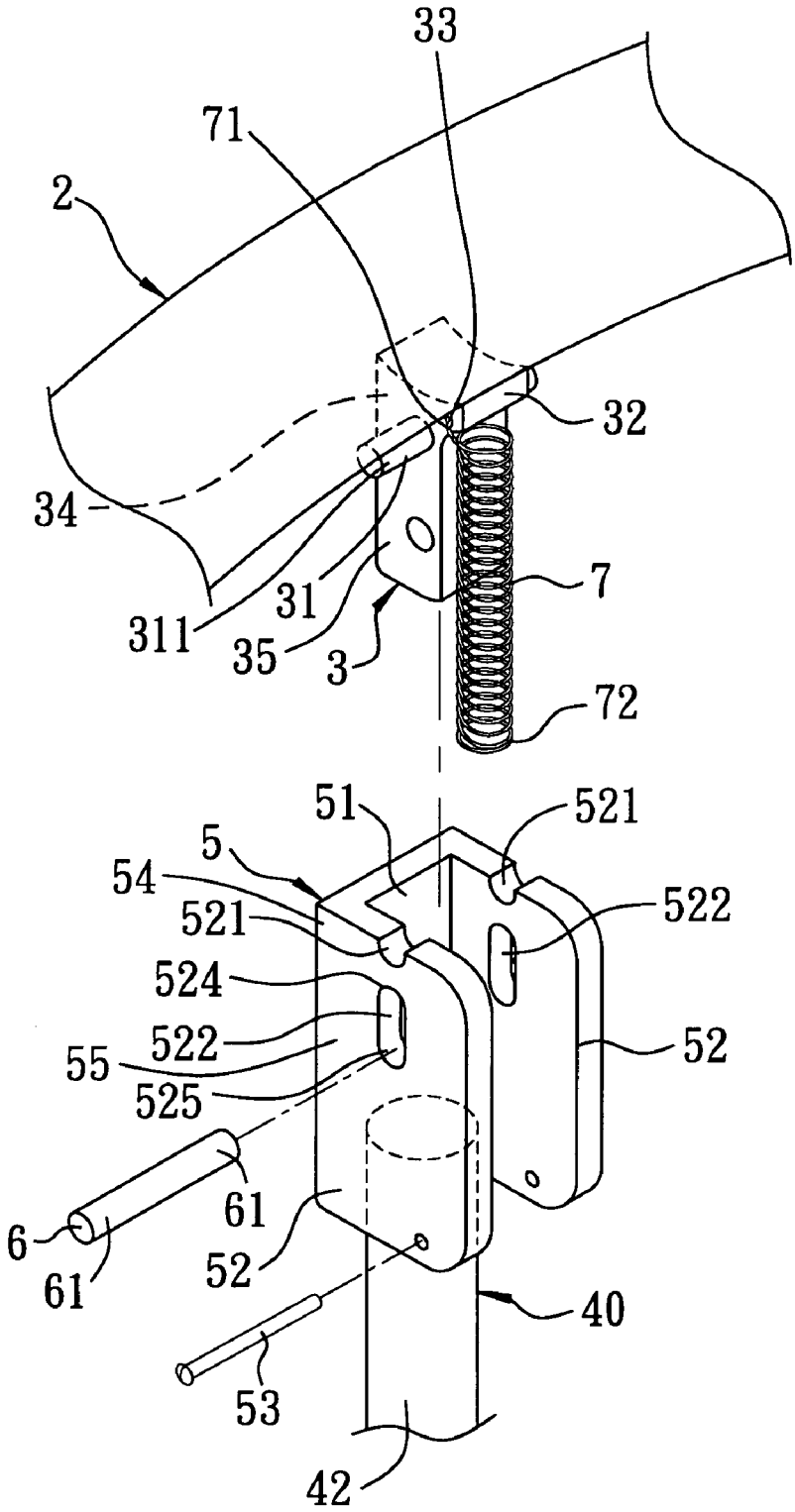
FIG. 5 is a fragmentary exploded perspective view of a portion of the preferred embodiment.
Figure 6:
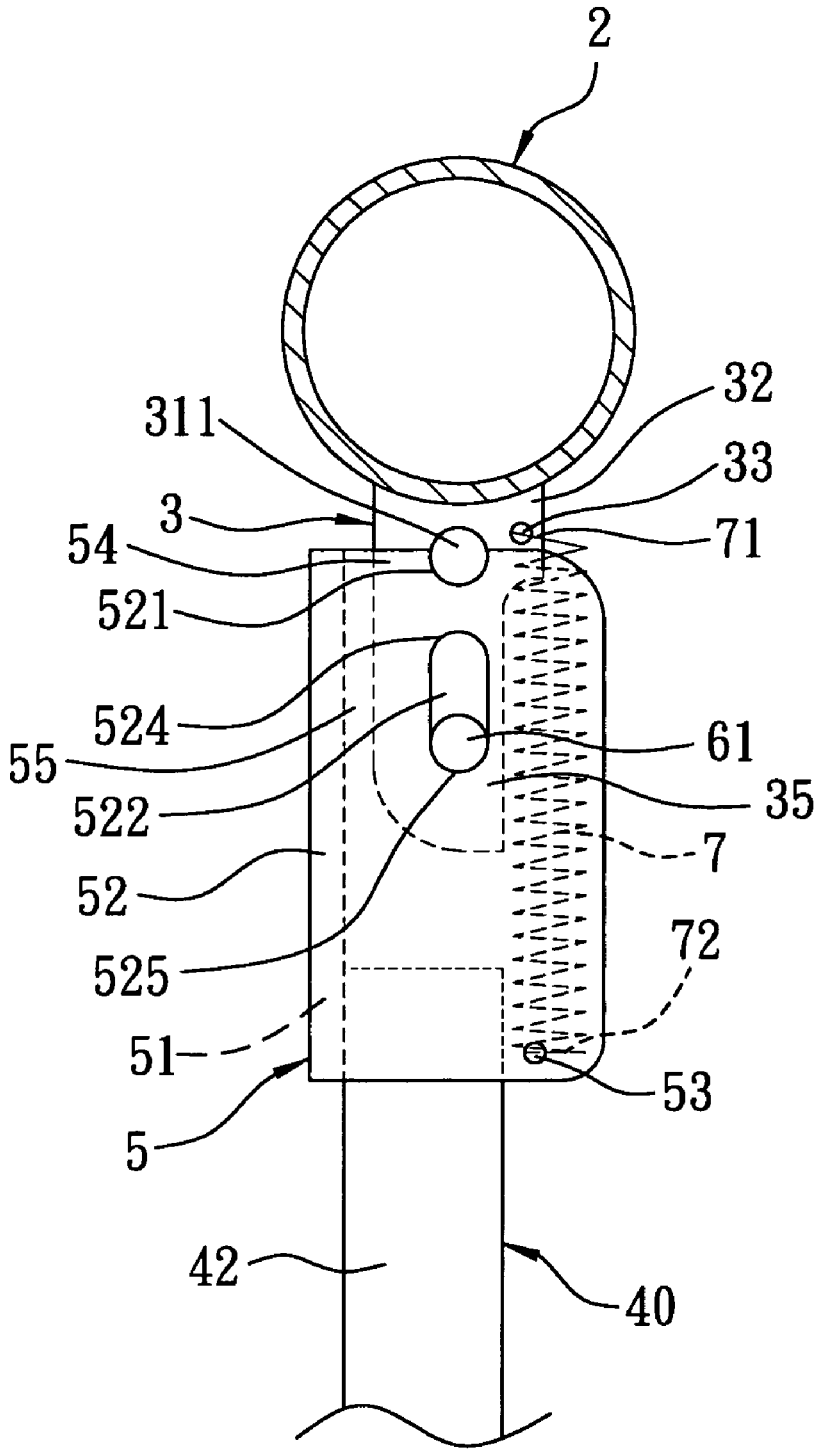
FIG. 6 is a fragmentary partly sectional view of the portion of the preferred embodiment in an upright state.

Referring to FIGS. 4 to 6, the preferred embodiment of a foldable article of furniture according to the present invention is shown to comprise a surrounding top supported frame 2, eight engaging members 3, four supporting leg units 4, eight couplers 5, eight joints, eight locking members, and eight biasing members 7.

The surrounding top supported frame 2 is a circular frame which surrounds a central axis, and is provided with a seat cushion (not shown) such that the foldable article of furniture serves as a chair. Alternatively, a table panel (not shown) may be supported on the top supported frame 2 to serve as a table.

The engaging members 3 are secured on a lower surface of the top supported frame 2, and are angularly displaced from one another. Each of the engaging members 3 includes upper and lower portions 34, 35 which are opposite to each other in an upright direction parallel to the central axis, and which are proximate to and distal from the top supported frame 2, respectively.

Each of the supporting leg units 4 includes a pair of supporting legs 40. Each of the supporting legs 40 includes a lower section 41 which is connected integrally to the lower section 41 of an adjacent one of the supporting legs 40 so as to be able to stand on the ground surface, and an upper section 42 opposite to the lower section 41 in the upright direction.

Each of the couplers 5 is secured on the upper section 42 of a respective one of the supporting legs 40, and includes a pair of side plates 52 which are spaced apart from each other in a transverse direction relative to the upright direction and which have upper edge walls flush with each other and facing upwardly to serve as an upper edge of the coupler 5, and a connecting plate 51 which interconnects the side plates 52 in a one-piece construction so as to confine a receiving space thereamong for receiving the lower portion 35 of the corresponding engaging member 3. The side plates 52 have upper and lower parts 54, 55 which are opposite to each other in the upright direction, which are distal from and proximate to the upper section 42 of the corresponding supporting leg 40, respectively, and which define distal and proximate portions of the coupler 5, respectively.

Each of the joints includes a keyway including a pair of elongated slots 522, and a key 6. The elongated slots 522 are respectively formed in the side plates 52 of a respective one of the couplers 5 at the proximate portion 55, and are elongated in the upright direction to have upper and lower ends 524, 525. The key 6 is secured to and extends from the lower portion 35 of the corresponding engaging member 3 in the transverse direction to define a pivot axis, and has two key ends 61 which are opposite to each other in the transverse direction and which respectively pass through the elongated slots 522 so as to be slidable therealong between the upper and lower ends 524, 525.

Figure 7:
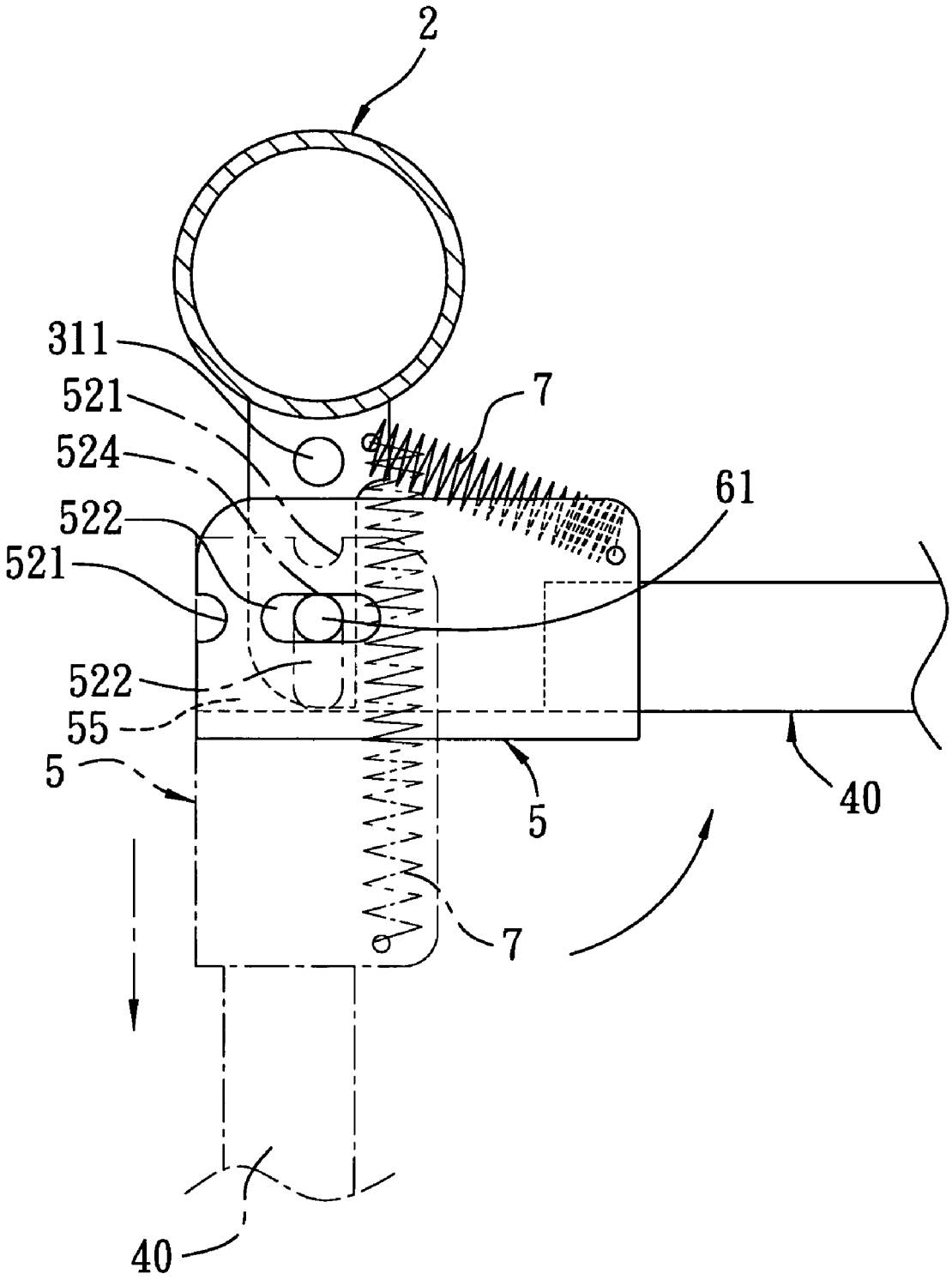
FIG. 7 is a fragmentary partly sectional view of the portion of the preferred embodiment in a folded state.

As such, the proximate portion 55 of the respective coupler 5, together with the upper section 42 of the respective supporting leg 40, is turnable relative to the lower portion 35 of the respective engaging member 3 about the pivot axis between an upright position, as shown in FIG. 6, where both the coupler 5 and the engaging member 3 are oriented in the upright direction so as to position the lower section 41 of the respective supporting leg 40 on the ground surface (see FIG. 4), and a collapsed position, as shown in FIG. 7, where the coupler 5 is inclined relative to the engaging member 3 so as to bring the supporting leg 40 close to the central axis. Furthermore, the proximate portion 55 is movable relative to the lower portion 35 in the upright direction between an upper position, as shown in FIG. 6, where the key ends 61 reach the lower ends 525, and a lower position, where the key ends 61 reach the upper ends 524, as indicated by dotted lines in FIG. 7.

Each of the locking members includes a cavity unit including a pair of cavities 521, and a latch 31. The cavities 521 are formed respectively in the upper edge walls of the side plates 52, and are registered with each other in the transverse direction. Each cavity 521 is concaved in the upright direction towards the proximate portion 55. The latch 31 is secured to and extends from the upper portion 34 of the engaging member 3 in the transverse direction, and has two latch ends 311 which are opposite to each other in the transverse direction and which are configured to be removably retained in the cavities 521, respectively. In this embodiment, each latch end 311 has a circular cross-section. Each cavity 521 has a depth in the upright direction, which is greater than the radius of the cross-section of the latch end 311 and which is smaller than the diameter of the latch end 311.

Each engaging member 3 has a protrusion 32 which extends from the upper portion 34 and which is formed with a hole 33. An anchored shaft 53 is secured between the side plates 52 of the respective coupler 5 adjacent to the upper section 42 of the respective supporting leg 40. Each of the biasing members 7 is a coil spring with two ends 71, 72 which are opposite to each other in the upright direction and which engage the hole 33 and the anchored shaft 53, respectively, so as to bias the cavities 521 to retain the latch ends 311.

With reference to FIGS. 4 and 7, when it is desired to fold the supporting leg units 4, i.e. to move the proximate portions 55 of the coupler 5, together with the supporting legs 40, to the collapsed position, the user only needs to pull each supporting leg unit 4 downwards against the biasing action of the biasing member 7 to move the proximate portions 55 of the couplers 5 to the lower position, thereby disengaging the cavities 521 from the latch ends 311, as indicated by the dotted lines in FIG. 7. The user can then turn each supporting leg unit 4 towards the central axis such that the proximate portions 55 of the couplers 5 are turned to the collapsed position, as indicated by the solid lines in FIG. 7. Therefore, the supporting leg units 4 can be folded for convenient storage and carrying. When stretching the supporting leg units 4, the user only needs to turn each supporting leg unit 4 away from the central axis such that the proximate portions 55 of the coupler 5 are moved to the upright direction. The proximate portions 55 are then moved to the upper position by means of the biasing members 7 to bring the latch ends 311 into engagement with the cavities 521, thereby preventing the proximate portions 55 of the coupler 5 from turning relative to the lower portions 35 of the engaging member 3 about the pivot axis.

As illustrated, since each supporting leg unit 4 can be operated with one hand for simultaneous movement of the proximate portions 55 of the corresponding couplers 5 relative to the corresponding engaging members 3 to the lower position, the collapsing and stretching operations are convenient to conduct.

It is noted that the number of the supporting leg units 4 may be two or three. The lower sections 41 of the supporting legs 40 may be formed as a plate for steady standing on the ground surface. Furthermore, the key 6 and the elongated slots 522 can be interchanged, i.e. the key 6 and the elongated slots 522 can be disposed on the coupler 5 and the engaging member 3, respectively.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A foldable article of furniture, comprising:

a surrounding top supported frame surrounding a central axis;

a plurality of engaging members secured on said top supported frame and angularly displaced from one another, each of said engaging members including upper and lower portions opposite to each other in an upright direction parallel to the central axis, and proximate to and distal from said top supported frame, respectively;

a plurality of supporting legs, each including a lower section which is adapted to stand on the ground surface, and an upper section opposite to said lower section in the upright direction;

a plurality of couplers secured on said upper sections of said supporting legs, respectively, each of said couplers including distal and proximate portions opposite to each other in the upright direction, and distal from and proximate to said upper section, respectively;

a plurality of joints, each disposed to connect said lower portion to said proximate portion such that said proximate portion is turnable relative to said lower portion about a pivot axis that is transverse to the central axis between an upright position, where both a respective one of said couplers and a respective one of said engaging members are oriented in the upright direction so as to position said lower section on the ground surface, and a collapsed position, where the respective one of said couplers is inclined relative to the respective one of said engaging members so as to bring said lower section close to the central axis, and such that said proximate portion is movable relative to said lower portion in the upright direction between upper and lower positions;

a plurality of locking members, each disposed to lock said proximate portion so as to prevent turning of said proximate portion relative to said lower portion about the pivot axis when said proximate portion is in the upper position, and to release said proximate portion so as to permit turning of said proximate portion about the pivot axis to the collapsed position when said proximate portion is in the lower position; and a plurality of biasing members, each disposed to bias said proximate portion towards the upper position;

wherein said distal portion of each of said couplers has an upper edge which faces upwardly, each of said locking members including a cavity unit which is formed in said upper edge and which extends in the upright direction towards said proximate portion, and a latch which extends from said upper portion in a transverse direction relative to the upright direction and which is configured to be retained in said cavity unit when said proximate portion is in the upper position, and to be removed from said cavity unit when said proximate portion is moved to the lower position against biasing action of a respective one of said biasing members;

each of said joints including a keyway which is formed in said proximate portion, which extends in the upright direction, and which has upper and lower ends, and a key which extends from said lower portion in the transverse direction to define the pivot axis, which is movable along said keyway, and which abuts against said upper and lower ends when said proximate portion is in the lower and upper positions, respectively;

each of said couplers including a pair of side plates which are spaced apart from each other in the transverse direction and which have upper edge walls flush with each other to serve as said upper edge, and a connecting plate which interconnects said side plates in a one-piece construction so as to confine a receiving space thereamong, said lower portion of each of said engaging members being received in said receiving space;

said cavity unit including a pair of cavities which are formed in said upper edge walls of said side plates and which are registered with each other in the transverse direction, said latch having two latch ends which are opposite to each other in the transverse direction and which are configured to be retained in said cavities, respectively;

said keyway including a pair of elongated slots which are formed in said side plates, respectively, and which are elongated in the upright direction, said key having two key ends which are opposite to each other in the transverse direction and which respectively pass through said elongated slots so as to be slidable along said elongated slots, respectively.

2. The foldable article of furniture of claim 1, wherein each of said latch ends has a circular cross-section, each of said cavities having a depth in the upright direction, which is greater than a radius of said cross-section of said latch ends and which is smaller than a diameter of said cross-section of said latch ends.

3. The foldable article of furniture of claim 1, wherein said lower sections of two adjacent ones of said supporting legs are connected to each other so as to facilitate simultaneous movement of said proximate portions of two corresponding ones of said couplers relative to two corresponding ones of said engaging members to the lower position.

4. A foldable article of furniture, comprising:

a surrounding top supported frame surrounding a central axis;

a plurality of engaging members secured on said top supported frame and angularly displaced from one another, each of said engaging members including upper and lower portions opposite to each other in an upright direction parallel to the central axis, and proximate to and distal from said top supported frame, respectively;

a plurality of supporting legs, each including a lower section which is adapted to stand on the ground surface, and an upper section opposite to said lower section in the upright direction;

a plurality of couplers secured on said upper sections of said supporting legs, respectively, each of said couplers including distal and proximate portions opposite to each other in the upright direction, and distal from and proximate to said upper section, respectively;

a plurality of joints, each disposed to connect said lower portion to said proximate portion such that said proximate portion is turnable relative to said lower portion about a pivot axis that is transverse to the central axis between an upright position, where both a respective one of said couplers and a respective one of said engaging members are oriented in the upright direction so as to position said lower section on the ground surface, and a collapsed position, where the respective one of said couplers is inclined relative to the respective one of said engaging members so as to bring said lower section close to the central axis, and such that said proximate portion is movable relative to said lower portion in the upright direction between upper and lower positions;

a plurality of locking members, each disposed to lock said proximate portion so as to prevent turning of said proximate portion relative to said lower portion about the pivot axis when said proximate portion is in the upper position, and to release said proximate portion so as to permit turning of said proximate portion about the pivot axis to the collapsed position when said proximate portion is in the lower position; and a plurality of biasing members, each disposed to bias said proximate portion towards the upper position;

wherein said distal portion of each of said couplers has an upper edge which faces upwardly, each of said locking members including a cavity unit which is formed in said upper edge and which extends in the upright direction towards said proximate portion, and a latch which extends from said upper portion in a transverse direction relative to the upright direction and which is configured to be retained in said cavity unit when said proximate portion is in the upper position, and to be removed from said cavity unit when said proximate portion is moved to the lower position against biasing action of a respective one of said biasing members;

each of said joints including a keyway which is formed in said proximate portion, which extends in the upright direction, and which has upper and lower ends, and a key which extends from said lower portion in the transverse direction to define the pivot axis, which is movable along said keyway, and which abuts against said upper and lower ends when said proximate portion is in the lower and upper positions, respectively;

each of said biasing members being a coil spring which has two ends that are opposite to each other in the upright direction and being secured to said upper portion and said proximate portion, respectively, so as to bias said cavity unit to receive said latch.

* * * * *